US006783455B2

(12) United States Patent
Glavich

(10) Patent No.: US 6,783,455 B2
(45) Date of Patent: Aug. 31, 2004

(54) GAMING DEVICE HAVING DIRECTIONAL BONUS SCHEME

(75) Inventor: Paulina Glavich, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 10/424,609

(22) Filed: Apr. 28, 2003

(65) Prior Publication Data

US 2003/0195028 A1 Oct. 16, 2003

Related U.S. Application Data

(63) Continuation of application No. 09/679,499, filed on Oct. 4, 2000, now Pat. No. 6,572,472.

(51) Int. Cl.[7] ..... A63F 9/24
(52) U.S. Cl. ..... 463/16
(58) Field of Search ..... 463/16–22, 25–28; 273/138.1, 143 R, 138.4

(56) References Cited

U.S. PATENT DOCUMENTS

| | | | |
|---|---|---|---|
| 5,910,046 | A | 6/1999 | Wada et al. |
| 5,919,088 | A | 7/1999 | Weiss |
| 5,931,467 | A | 8/1999 | Kamille |
| 5,997,400 | A | 12/1999 | Seelig et al. |
| 6,015,346 | A | 1/2000 | Bennett |
| 6,059,289 | A | 5/2000 | Vancura |
| 6,089,977 | A | 7/2000 | Bennett |
| 6,159,097 | A | 12/2000 | Gura |
| 6,203,429 | B1 | 3/2001 | De mar et al. |
| 6,290,600 | B1 | 9/2001 | Glasson |
| 6,296,568 | B1 | 10/2001 | Tracy |
| 6,406,369 | B1 | 6/2002 | Baerlocher |

FOREIGN PATENT DOCUMENTS

| | | |
|---|---|---|
| EP | 0945837 A2 | 9/1999 |
| GB | 2090690 | 7/1982 |
| GB | 2106293 | 4/1983 |
| GB | 2153572 | 8/1985 |
| GB | 2181589 | 4/1987 |
| GB | 2225889 | 6/1990 |
| GB | 2242300 | 9/1991 |
| WO | WO 00/12186 | 3/2000 |

OTHER PUBLICATIONS

Party Time—Cash Quest Brochure written by IGT, published in 1999.
Monopoly Brochures and Articles written by WMS Gaming, Inc., published in 1998, 1999 and 2000.
Jackpot Party Brochures and Articles written by WMS Gaming, Inc., published in 1998.
Big Bang Piggy Banking brochure written by WMS Gaming, Inc., undated.

*Primary Examiner*—Michael O'Neill
(74) *Attorney, Agent, or Firm*—Bell, Boyd & Lloyd LLC

(57) ABSTRACT

The present invention relates to a directional bonus scheme for a gaming device which includes a starting position, a plurality of non-terminating positions, a plurality of terminating positions, and a final terminating position. The game randomly generates a direction of movement for a position indicator. The game awards the player with a credit value when the position indicator reaches a non-terminating position. The bonus round terminates when the position indicator reaches a terminating position. The game awards a bonus credit value to the player when the position indicator reaches a final terminating symbol.

100 Claims, 7 Drawing Sheets

GAMING DEVICE HAVING DIRECTIONAL BONUS SCHEME

PRIORITY CLAIM

This application is a continuation of and claims priority to and the benefit of U.S. patent application Ser. No. 09/679,499, filed Oct. 4, 2000 now U.S. Pat. No. 6,572,472.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device with a directional bonus scheme wherein players receive credits for positions randomly selected by the gaming device.

BACKGROUND OF THE INVENTION

Gaming machines currently exist with bonus schemes in which a player has one or more opportunities to choose a particular selection or symbol from a group of symbols. The player randomly chooses a symbol having a predetermined credit value. The bonus scheme either awards the player a bonus value or terminates the bonus round. The outcome depends upon each particular symbol selected by the player.

When the player selects a symbol which awards a bonus or credit value, the player receives bonus credits. Each time the player selects a symbol which awards a bonus value, the bonus scheme typically displays a message for the player to continue. This message indicates that the bonus round continues and another symbol may be selected. The gaming device selects another symbol, and this process continues until the player selects a bonus round terminator which terminates the bonus round. European Patent Application No. EP 0 945 837 A2 filed on Mar. 18, 1999 and assigned on its face to WMS Gaming, Inc. discloses a bonus scheme generally of this type. Many other bonus games are known. Since players are seeking more entertainment and enjoyment, it is desirable to provide players with new bonus schemes where the players have multiple opportunities to receive winning payouts.

SUMMARY OF THE INVENTION

The present invention overcomes the above shortcomings by providing a gaming device and method which provides players with a directional bonus scheme. The directional bonus scheme of the present invention provides a player with a plurality of positions. The gaming device randomly selects the direction of movement from a starting position to a plurality of positions and then to a terminating position.

Preferably, the majority of the positions are non-terminating positions which have credit values, where the amount of the credit values varies. Certain positions terminate the bonus round (hereinafter referred to as "terminating positions"). When the position indicator is at any non-terminating position, the game will preferably award the player with a bonus or credit value and then continue the bonus round.

In operation, the device randomly chooses a direction of movement for the position indicator (which represents the player's position). If the game directs movement to a non-terminating position, the game awards the player a bonus or credit value. As long as the player avoids a terminating position, the game randomly selects another direction of movement and moves the position indicator to such position. The player receives bonus or credit values as appropriate. This process continues until the device ultimately selects a terminating position. The gaming device thus randomly creates a bonus or credit path. Preferably, the game include a final position which awards the player with a larger bonus or credit value and terminates the game.

According to one embodiment of the present invention, the positions are represented by squares in a grid. The majority of positions are identical in size and shape. The player causes the game to randomly select a direction of movement by activating a button such as by touching a spin button on a touch screen. After the gaming device randomly chooses a direction of movement, the device moves the position indicator to the position in that direction. If the position is a terminating position, the bonus round terminates. If the position is a non-terminating position, the game awards the player with a bonus or credit value and the player is prompted to request another directional movement. It should be appreciated that the terminating positions could be positioned differently or randomly in each bonus round.

It is therefore an object of the present invention to provide a gaming device with a directional bonus scheme.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1:
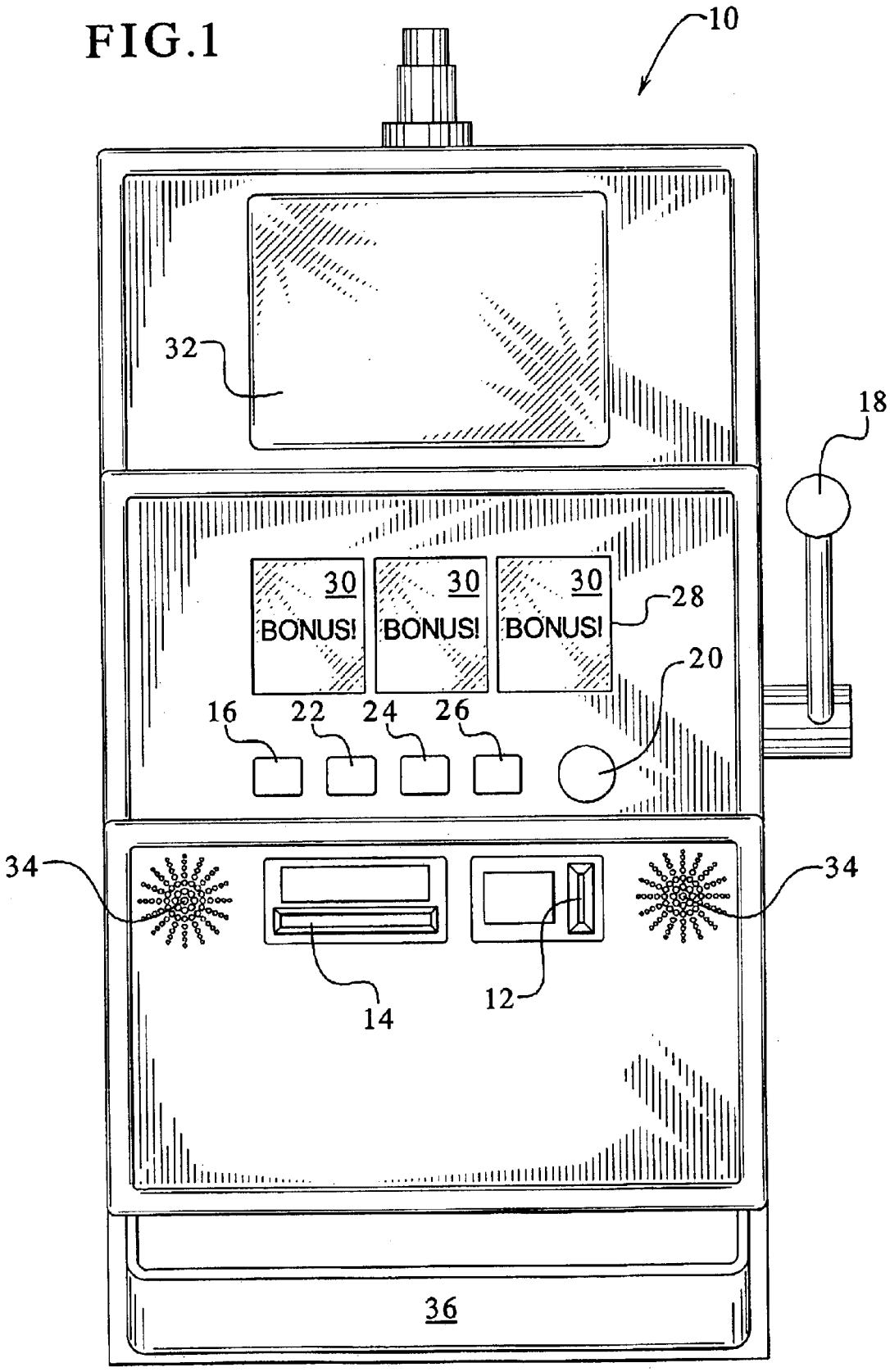
FIG. 1 is a front plan view of one embodiment of the gaming device of the present invention.

Referring now to the drawings, a gaming device 10 of one embodiment of the present invention, which is preferably a slot machine having the controls, displays and features of a conventional slot machine is generally illustrated. Gaming device 10 is constructed so that a player can operate gaming device 10 while standing or sitting. However, it should be appreciated that gaming device 10 can be constructed as a pub-style table-top game (not shown) which a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno in addition to any of their bonus triggering events which trigger the bonus scheme of the present invention. The symbols and indicia used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18, pushing play button 20 or activating any other mechanism (including a touch screen) which starts the game.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a display window 28 which contains a plurality of reels 30, preferably three to five reels in mechanical or video form. Each reel 30 displays a plurality of indicia such as bells, hearts, fruits, numbers, letters, bars or other images which preferably correspond to a theme associated with the gaming device 10. If the reels 30 are in video form, the gaming device 10 preferably displays the video reels 30 at display 32 instead of at display window 28. It should be appreciated that if the indicia includes an audio response, such audio is provided through speakers 34.

The display 32 is selected from the group consisting of cathode ray tubes "CRTs", high resolution flat panel LCDs, projection type LCDs, plasma displays, field emission displays, digital micromirror displays, LCD touchscreens, flat TV displays or other suitable displays. The display 32 is capable of portraying or displaying images, symbols and other indicia including images of people, characters, places, things and card faces associated with the game. This display 32 generally attracts patrons to play the game.

In one preferred embodiment, the display 32 is an LCD which is used to display images, symbols and other indicia including secondary games which represent a bonus game (a secondary game for which a bonus is awarded to the primary game). It should be appreciated that the display window 28 containing reels 30 and display 32 could be combined into one display so that the display 32 provides the reels 30 in video form along with the images, symbols and other indicia of the gaming device 10. Furthermore, a plurality of smaller display could combine to form display 32 and used with the present invention.

At any time during the primary game, a player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards which keep track of the player's credits.

Figure 2:
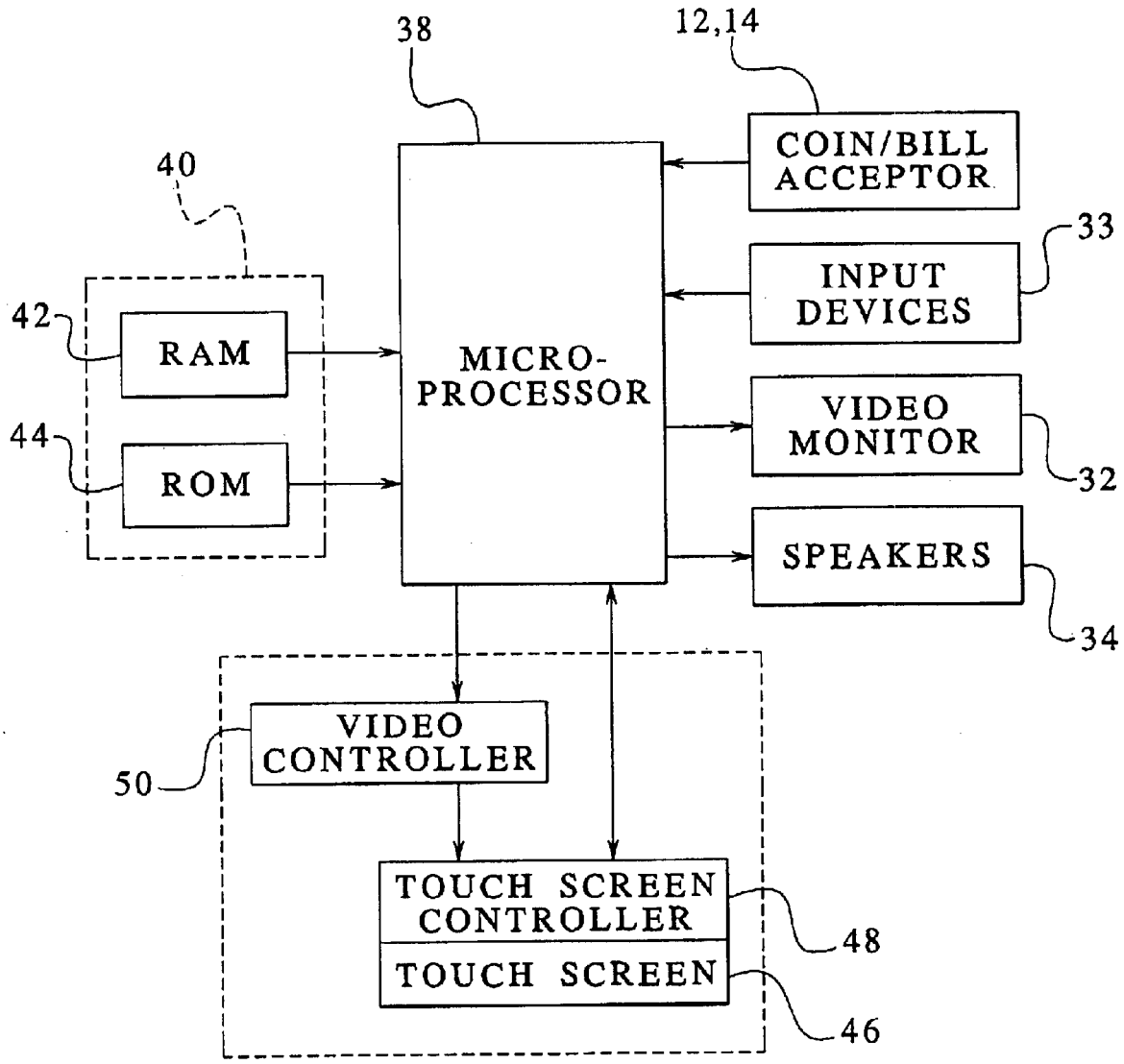
FIG. 2 is a schematic block diagram of the electronic configuration of one embodiment of the gaming device of the present invention.

With respect to electronics, gaming device 10 preferably includes the electronic configuration generally illustrated in FIG. 2, including a processor 38, a memory device 40 for storing program code or other data, a display 32 or other display device (i.e., video monitor or liquid crystal display) and at least one input device such as play buttons 20. The processor 38 is preferably a microprocessor or microcontroller-based platform which is capable of displaying images, symbols and other indicia such as images of people, characters, places, things and faces of cards. The memory device 40 can include random access memory (RAM) 42 for storing event data or other data generated or used during a particular game. The memory device 40 can also include read only memory (ROM) 44 for storing program code which controls the gaming device 10 so that it plays a particular game in accordance with applicable game rules and pay tables.

As illustrated in FIG. 2, the player preferably uses input devices 33 (comprising play buttons 20 or arm 18) to input signals into gaming device 10. Furthermore, it is preferable that touch screen 46 and an associated touch screen controller 48 are used. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 are generally referred to herein as the "computer" or "controller".

With reference to FIGS. 1 and 2, to operate the gaming device 10, the player must insert the appropriate amount of money or tokens at coin slot 12 or bill acceptor 14 and then activate the input device 33 (i.e., pull the arm 18 or push the play button 20). The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, preferably gaming device 10 also provides players the opportunity to win credits in a secondary or directional bonus round. This type of gaming device 10 includes a program which automatically begins a secondary or directional bonus round when the player has achieved a qualifying condition in the game. This qualifying condition can be a particular arrangement of indicia on the display window 28. The gaming device 10 also includes a display device such as a display 32 shown in FIG. 1. The display 32 provides images and produces sounds, enabling the player to play the bonus round. Preferably, the qualifying condition is a predetermined combination of indicia appearing on a plurality of reels 30. As illustrated in the three reel slot game shown in FIG. 1, the qualifying condition could be the text "BONUS" appearing in the same location on three adjacent reels 30 during the primary game.

Bonus Scheme

Figure 3:
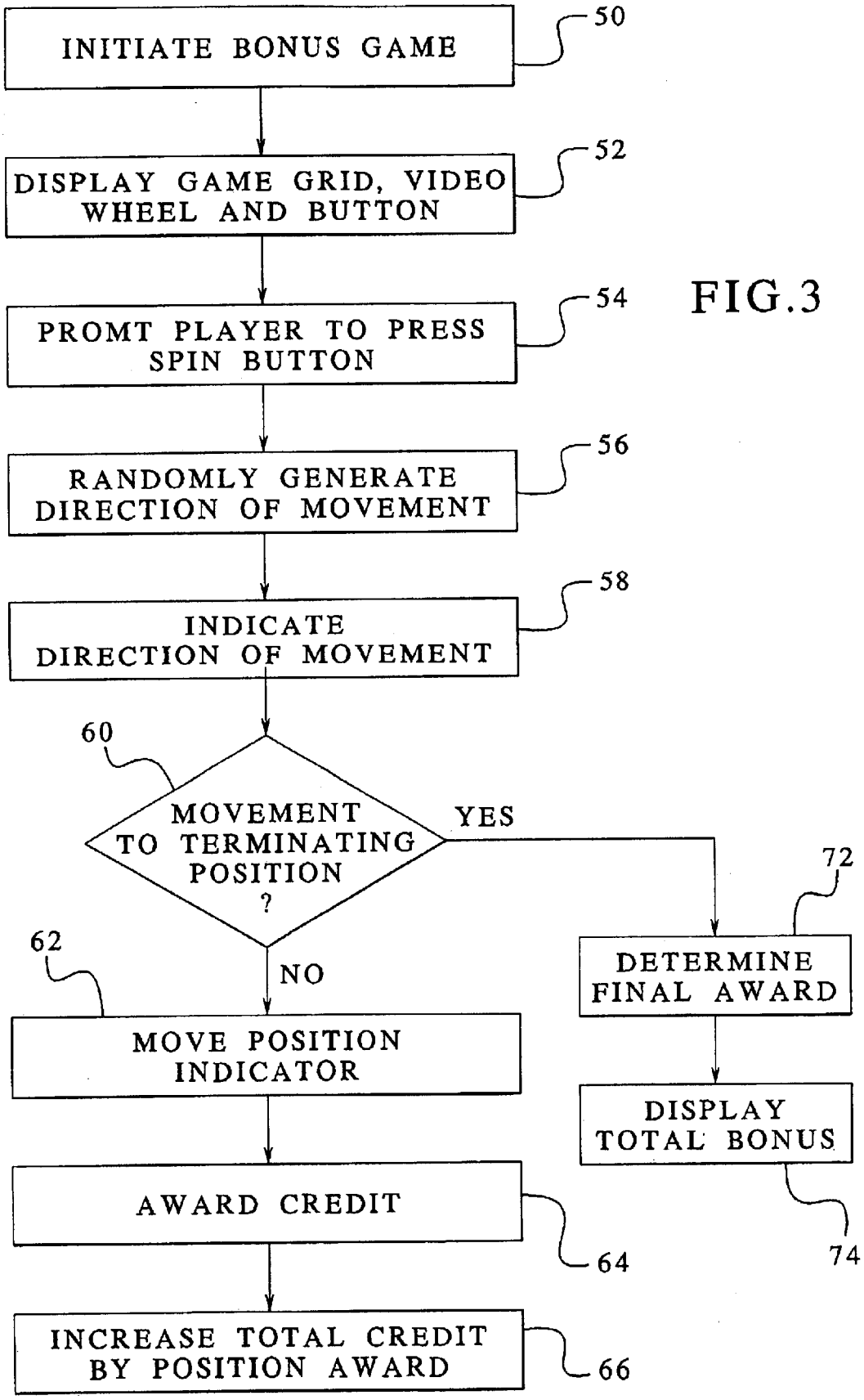
FIG. 3 is a flow diagram of one embodiment of the directional bonus scheme of the present invention.

If a player achieves a bonus triggering or qualifying condition when playing the primary game, the gaming device 10 automatically begins the bonus round of the present invention. The bonus round of the present invention initiates the bonus game as indicated by block 50 in FIG. 3. It is anticipated that the bonus game includes images consisting of various graphics and having various sizes, shapes and colors. In one preferred embodiment of the present invention, the bonus game displays squares in a grid as illustrated in FIGS. 4 to 7.

The gaming device 10 displays the game grid including the positions, directional indicator and a spin button (illustrated in FIGS. 5 and 6), as indicated by block 52. The gaming device prompts the player to press the spin button (illustrated in FIG. 5) exhibited by the display 32 as indicated by block 54. Each time the player presses the button, the gaming device randomly generates a direction of movement as indicated by block 56. The directional indicator provides the direction of movement on the grid as indicated by block 58.

In one preferred embodiment, the directional indicator has two directional arrows, and in particular an up arrow and a right arrow. The player has a fifty percent chance that the directional indicator will display the up arrow and a fifty percent chance that the directional indicator will display the right arrow. While only two arrows are preferred, other arrangements are contemplated. For example, the directional indicator could include up, down, left, right and diagonal arrows (among others) permitting more selections and varying the direction of movement.

As illustrated in FIGS. 4 to 7, the plurality of positions or the grid includes a start position, a plurality of non-terminating positions and a plurality of terminating positions. After the player presses the spin button, the directional indicator displays the arrow which indicates the direction of movement for the position indicator (i.e., either moving up or to the right starting from the starting position).

As mentioned above, the non-terminating positions or boxes preferably contain different credit values. In one preferred embodiment, the credit values are hidden by a symbol. In another embodiment, the credit values are displayed to the player. The non-terminating symbols could also be blank, could trigger other bonus events, or could include non-terminating credits which can be subsequently used during the bonus games to continue the bonus game if the player is directed to a terminating position. The plurality of terminating positions, which are preferably labeled "COLLECT," terminate the bonus round. While a plurality of terminating symbols are preferred, it should be appreciated that any desired number of terminating positions could be employed. It should also be appreciated that the terminating symbols could be randomly positioned, that the terminating positions could change each time the bonus round is played and that the terminating positions could change during the bonus game, such as after each spin or after a plurality of spins.

The non-terminating positions preferably provide credit points or values earned by the player during the bonus game. As mentioned above, these positions have different credit values which are displayed to the player during the game. As mentioned above, in an alternative embodiment the credit values could be masked. Each time the position indicator moves to a new or next position, the associated credit values are revealed. The terminating positions could also be masked.

It is further contemplated that different symbols or numbers could be used with the directional bonus game. For example, the gaming device 10 could exhibit different icons such as stars, moons and clouds where each position has a different value. Alternatively, the game could use colors where blue would have a different value from red and both these colors would have a different value from the green symbol.

Referring back to FIG. 3, the gaming device 10 terminates the bonus round when the position indicator is directed to a terminating position. Specifically, the gaming device 10 determines if the position indicator is moved to a terminating position as indicated by diamond 60. If so, the game determines and displays the player's total award as indicated in blocks 72 and 74. If not, the game continues and the position indicator moves to the non-terminating position as indicated by block 62 (i.e., highlights the non-terminating position) and awards the player the credit value, if any, associated with the non-terminating position as indicated by blocks 64 and 66. The game also maintains or highlights the previous positions of the position indicator so that a credit path is displayed. Additionally, the game changes the arrow color between the previous position and the current position which again indicates the direction of the credit path.

It should be appreciated that the terminating positions are preferably arranged such that the game does not terminate on the first play. That is, the gaming device will not initially direct the position indicator to a terminating position, and preferably directs movement to a position with a credit value and awards that credit value to the player. In the preferred embodiment, a plurality of the non-terminating positions are not adjacent to a terminating position (i.e., the position indicator cannot be directed to a terminating position from one of these non-terminating positions). The player is thus guaranteed another opportunity to move when the position indicator is in one of those non-terminating positions.

Eventually, the position indicator moves to a terminating position as indicated by the diamond 60 (i.e., a "COLLECT" position). The gaming device determines the final total for the player based on the amounts awarded previously as illustrated by box 72 and the total bonus is awarded to the player as indicated by block 74.

The preferred embodiment includes a final terminating position. If the position indicator reaches this position, the player preferably receives a larger bonus, increasing the player's current total by that bonus amount and the game terminates.

As mentioned above, it should be appreciated that the non-terminating and terminating positions are not fixed. That is, the game can rearrange the positions each time a new directional bonus round begins. This rearrangement prevents the positions from being located in the same place on the display from bonus round to bonus round. This adds to the excitement and prevents the player from getting bored by playing the same game. The random selection of the directional indicator adds excitement and enjoyment to the game.

In one preferred embodiment of the present invention, display 32 displays the directional bonus game 80. The directional bonus game 80 of the present invention exhibits a plurality of positions 82 displayed in a seven by seven grid 88. The non-terminating position 82 have points or credit values 84 the player can earn.

Grid 88 includes a total of 46 positions comprising 29 non-terminating positions (i.e., having credit value) and 17 other positions. The other positions comprise one start position 90 and 16 terminating positions 92. Each of the positions includes a display area 94 and a frame 96. For the non-terminating positions, the display area 94 contains the appropriate credit value 84. The display area 94 for the start position 90 preferably exhibits the term "START." The display area 94 for the terminating position 92 preferably exhibits the term "COLLECT." The display area 94 for the final terminating symbol 98 contains the phrase "COLLECT 750." This symbol 98 is the end point of the game which awards the player additional bonus credit value if reached.

The game uses the position indicator to successively indicate the positions 82 as based on the directional indicator. The positions create a credit path 100 (illustrated in FIGS. 5 through 7). At least one arrow 102 is associated with each non-terminating position 82. Each arrow 102 indicates the next possible position or possible direction for the credit path. In the illustrated embodiment, two arrows 102 are associated with each non-terminating position 82. The two arrows are transverse to each other. In the preferred embodiment, up and right arrows 102A and 102B, respectively, are associated with each non-terminating position.

The gaming device 10 selects a directional indicator from the arrows located above and to the right of the currently indicated positions 82. Each of these two arrows has an equal chance of being selected. Each successive position 82 is indicated. If the gaming device 10 selects a non-terminating symbol, the display 32: (i) pops out the position 82, adding a 3-D effect; (ii) highlights the position 82 by lighting the frame 96; (iii) changes the color of the arrow 102 associated with the position; (iv) grays out the credit value 84 exhibited in the credit box 86; and (v) increases the player's current total by the credit value 84. It should be appreciated that popping out the position 82, highlighting the position 82, changing the color of the arrow 100 and graying out the credit value 84 creates the credit path 100 as discussed previously.

The start position 90 exhibits the label "START", the display area 94 for the terminating position 92 exhibits the label "COLLECT", while display area 94 for the end of the final terminating position 98 contains the label "COLLECT 750." This position 98 is the end point of the game 80, awarding the player additional bonus credit value if reached.

It should be appreciated that the players object is to earn as many bonus points (i.e., credit values 84) as possible. Therefore, the object of the bonus game 80 is to reach the final terminating position 98 before any of the other terminating position 92.

Figure 4:
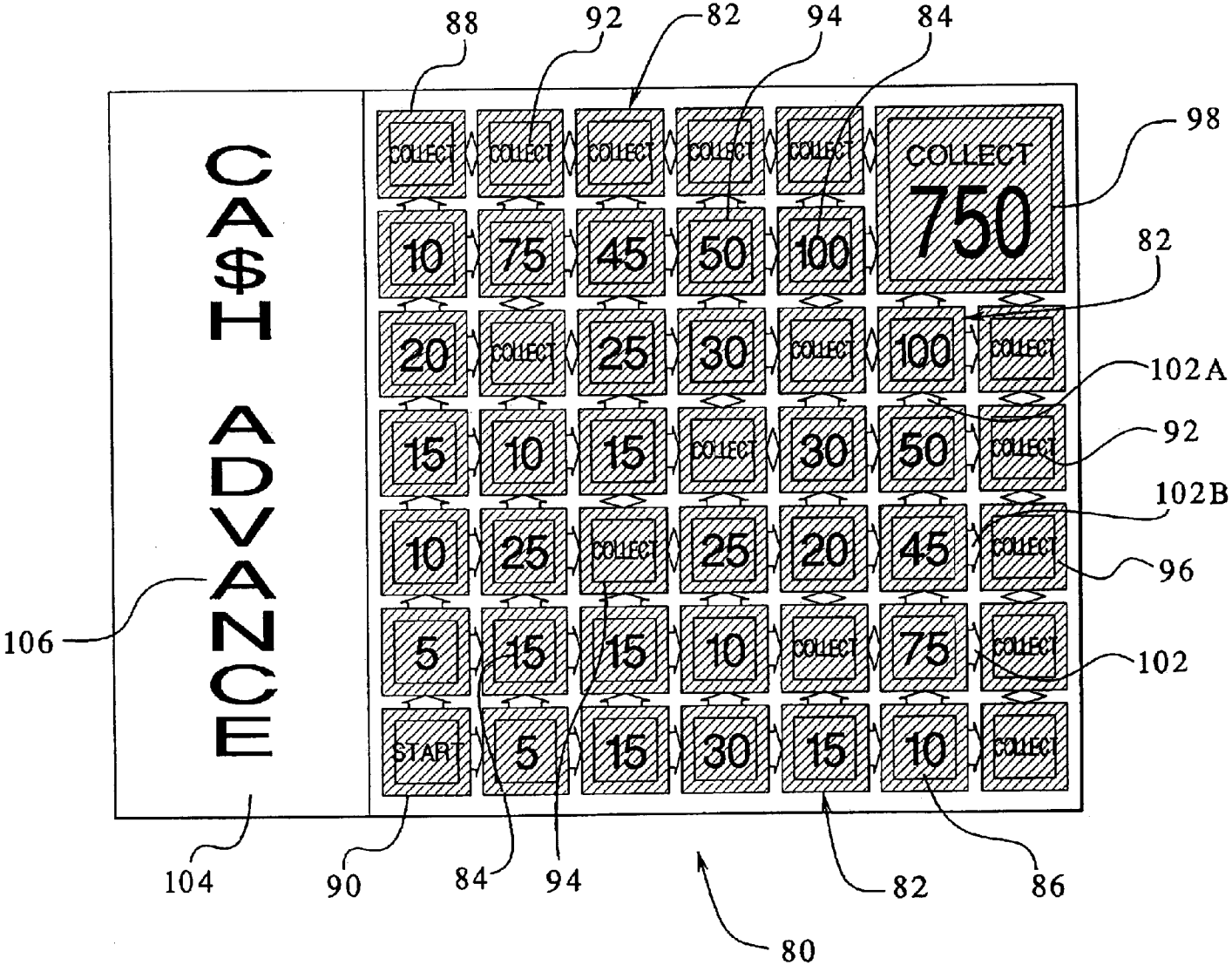
FIG. 4 is a plan view of the grid and positions in one embodiment of the bonus scheme of the present invention.
Figure 5:
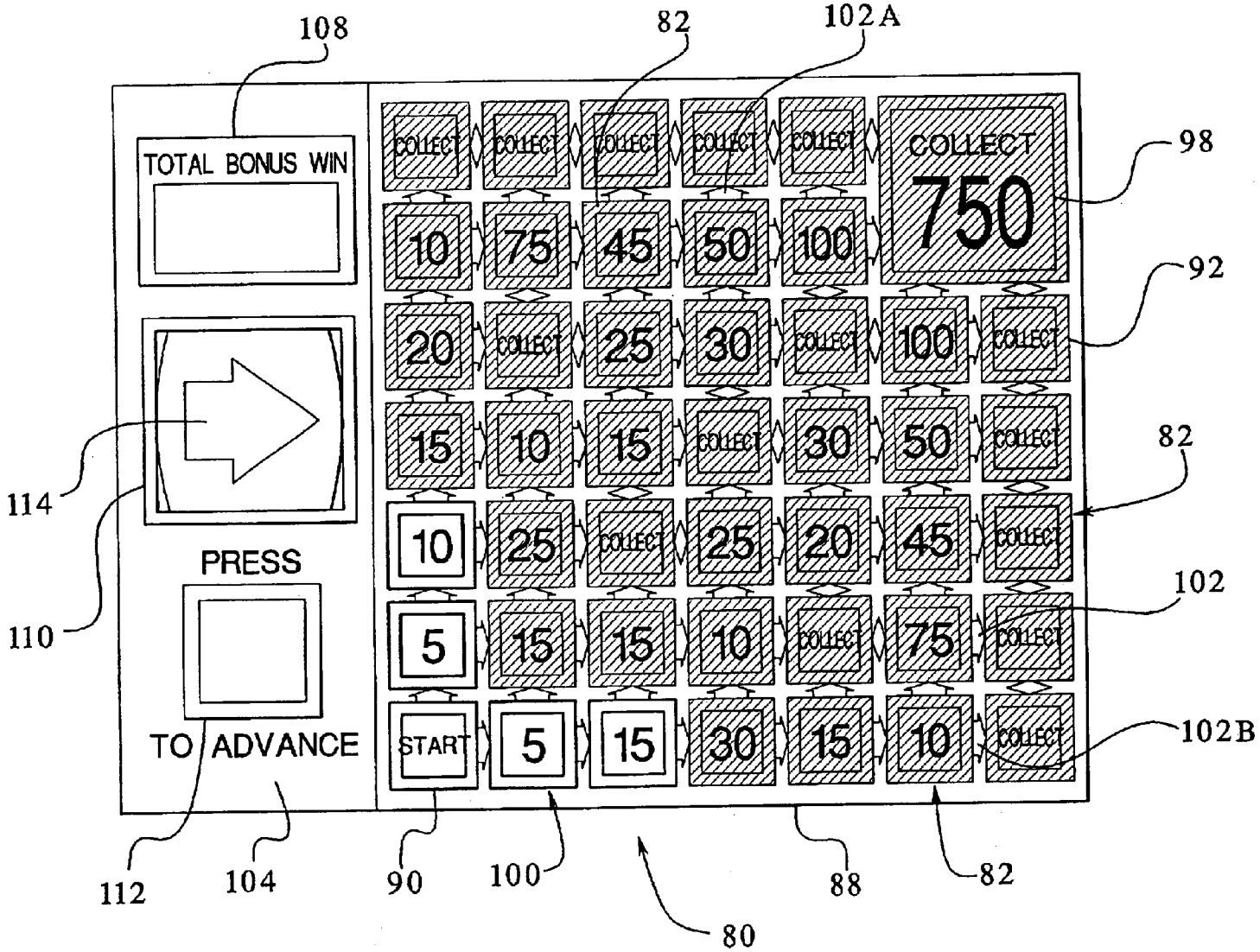
FIG. 5 is a second plan view of the grid and positions of the present invention depicting the direction indicator and a credit path.
Figure 6:
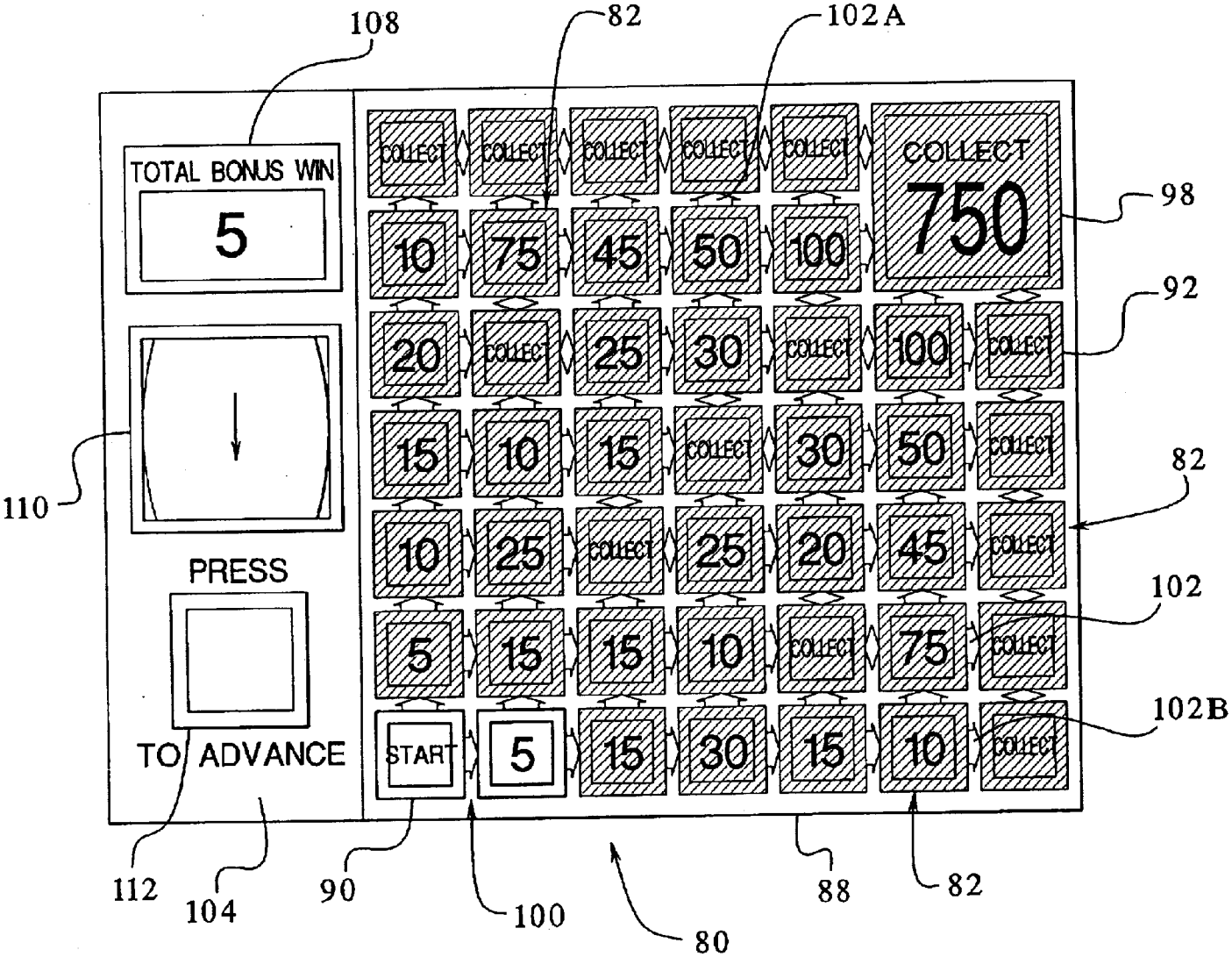
FIG. 6 is a third plan view of the grid and positions of the present invention depicting selecting the position and the credit value.
Figure 7:
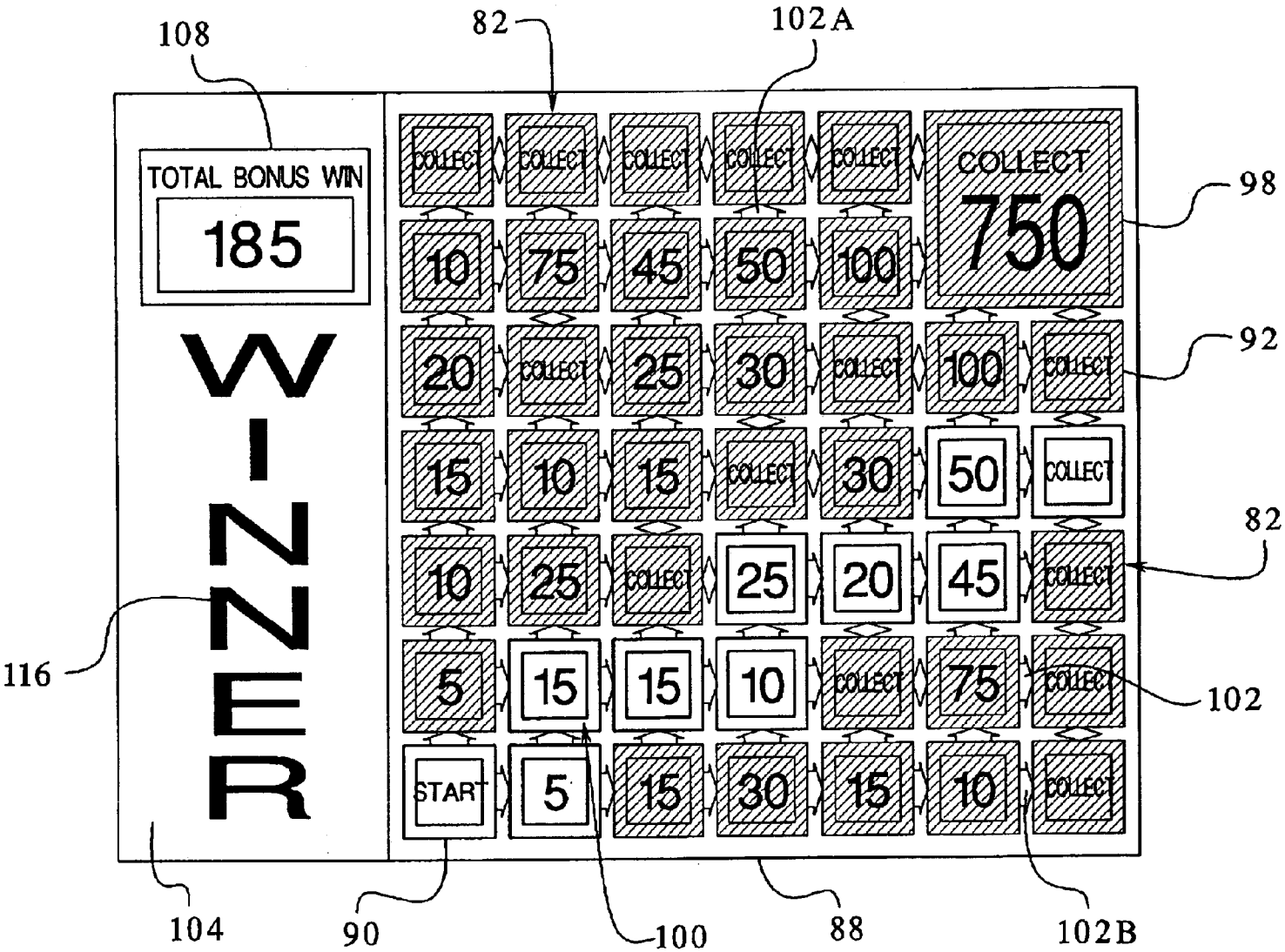
FIG. 7 is a fourth plan view of the grid and positions of the present invention depicting winning the bonus game.

Display 32 includes a non-grid area 104 for exhibiting other features of the bonus game 80. The non-grid area 104 displays a flag 106 advertising the name of the bonus game 80. In this embodiment, flag 106 includes the phrase "CASH ADVANCE" as illustrated in FIG. 4. CASH ADVANCE is a trademark of the assignee of this application and is not part of the present invention. The non-grid area 104 includes a credit value meter 108, directional indicator 110 and the spin button 112 as illustrated in FIGS. 5 and 6. The value meter 108 displays a running total of all credit values (i.e., current total) as they are earned. Upon reaching a terminating symbol, the value meter displays the final total including any bonus credit values as appropriate.

The directional indicator 110 displays an indicator or arrow 114 that indicates the direction of the next movement. In the preferred embodiment, the directional indicator 110 includes up and right arrows, where each arrow has a fifty percent chance of being displayed as illustrated in FIG. 5. It should be appreciated that FIG. 5 does not illustrate two credit paths, rather FIG. 5 illustrates alternative methods of displaying the credit paths 100 (i.e., up or to the right). However, it should also be appreciated that other directions are contemplated (i.e., down, diagonal, etc.). The button 112 initiates the spinning of the direction indicator 110 and the selection of the arrow 114 as discussed previously.

The non-grid area 104 also includes a second flag 116 signaling the termination of the bonus game 80. In the preferred embodiment, the non-grid area 104 exhibits the value meter 108 containing the final total as earned by the player and a second flag 116 including the phrase "WINNER." It should be appreciated that upon displaying this second flag 116, the display device 10 returns to the primary game.

The bonus game of the present invention offer players a heightened level of excitement because the game offers the player a plurality of credit paths through the grid to obtain the large bonus and the outcome is completely randomly determined.

In one alternative embodiment of the present invention, the game awards the player with a consolation value. The game awards a player with a consolation value when the bonus round terminates and preferably when the position indicator reaches a terminating position. The consolation value can be any predetermined or randomly generated value.

In another alternative embodiment of the present invention, the game awards the player with a bonus value for reaching certain non-terminating unrelated or related positions. It should be appreciated that this bonus value can be any amount and can be determined in any manner. For example, this bonus value can be the product of a predetermined numeric factor (i.e., two) multiplied by the sum of all values awarded to the player thus far in the bonus round. In another example, this bonus value can be any predetermined number.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is claimed as follows:

1. A gaming device comprising:

a game operable upon a wager by a player;

a plurality of non-terminating adjacently arranged positions;

at least one terminating position, wherein the terminating position is arranged adjacent to at least one of the non-terminating positions;

a position indicator displayable at each of said plurality of positions;

a processor operable to sequentially randomly determine each of a plurality of directions of movement of said position indicator from at least two different directions of movement, wherein said determination is independent of the arrangement of the terminating and non-terminating positions, and to sequentially move the position indicator to one of the adjacent positions for each of the determined sequential directions until said position indicator moves to one of the terminating positions; and a display device operable with the processor to display the terminating and non-terminating positions and the position indicator moving to said terminating and non-terminating positions.

2. The gaming device of claim 1, which includes a plurality of terminating positions each arranged adjacent to one of the non-terminating positions.

3. The gaming device of claim 1, wherein the non-terminating and terminating positions are fixed prior to sequentially determining the plurality of directions of movement.

4. The gaming device of claim 1, which includes an award associated with at least one of the non-terminating positions, wherein said award is provided to the player if the position indicator moves to said non-terminating position.

5. The gaming device of claim 4, wherein the award includes a multiplier.

6. The gaming device of claim 4, which includes an award associated with at least one of the terminating positions which is larger than any award associated with any of the non-terminating positions.

7. The gaming device of claim 1, which includes a plurality of awards associated with a plurality of the non-terminating positions, wherein the player is provided each award associated with each non-terminating position moved to by the position indicator.

8. The gaming device of claim 7, wherein the award associated with one of the non-terminating positions is larger than other said awards and the position indicator does not move after moving to said non-terminating position.

9. The gaming device of claim 1, which includes a plurality of awards, wherein one of said awards is associated with each non-terminating position, and wherein the player is provided each award associated with each non-terminating position moved to by the position indicator.

10. The gaming device of claim 1, which includes an award provided to the player based on a number of non-terminating positions moved to by the position indicator.

11. The gaming device of claim 1, which includes a consolation award associated with at least one of the terminating positions.

12. The gaming device of claim 1, wherein each of said different directions of movement has an equal probability of being selected.

13. The gaming device of claim 1, which has an electronic configuration adapted to receive input through a network.

14. The gaming device of claim 13, wherein the network is selected from the group consisting of a playing station network, a local area network, a wide area network and an internet.

15. A gaming device comprising:

a game operable upon a wager by a player;

a plurality of positions, wherein the plurality of positions includes a plurality of adjacently arranged non-terminating positions and at least one terminating position arranged adjacently to at least one of the non-terminating positions;

a position indicator, wherein the position indicator is operable to move to each of said plurality of positions;

a processor which sequentially randomly determines a plurality of directions of movement of the position indicator from at least two different directions of movement independent of the arrangement of the terminating and non-terminating positions, sequentially moves said position indicator to another one of the non-terminating positions in the determined sequential directions until said position indicator moves to one of the terminating positions, and provides an outcome to a player based on the non-terminating positions moved to by the position indicator; and a display device operable to display the outcome, the terminating and non-terminating positions and the position indicator moving to said terminating and non-terminating positions.

16. The gaming device of claim 15, wherein said outcome includes an award associated with at least one of the non-terminating positions.

17. The gaming device of claim 15, wherein said outcome is based on a number of non-terminating positions moved to by the position indicator.

18. The gaming device of claim 15, wherein said outcome includes triggering a bonus game.

19. The gaming device of claim 15, wherein said outcome allows the player to continue the game if said player is directed to said terminating position.

20. The gaming device of claim 15, which includes a plurality of terminating positions, each adjacently arranged to at least one of the non-terminating positions.

21. The gaming device of claim 15, wherein the non-terminating and terminating positions are fixed prior to sequentially determining the plurality of directions of movement.

22. The gaming device of claim 15, wherein each of said different directions of movement has an equal probability of being selected.

23. The gaming device of claim 15, which has an electronic configuration adapted to receive input through a network.

24. The gaming device of claim 23, wherein the network is selected from the group consisting of a playing station network, a local area network, a wide area network and an internet.

25. A gaming device comprising:

a game operable upon a wager by a player;

a plurality of non-terminating positions;

at least one terminating position;

a position indicator;

a display device; and a processor operable to:

(a) adjacently arrange the non-terminating positions and the terminating positions, (b) cause the display device to display the adjacently arranged non-terminating and terminating positions, (c) sequentially randomly determine the plurality of directions of movement of the position indicator, each determination from at least two different directions of movement and each determination independent of the arrangement of the terminating and non-terminating positions, and (d) communicate with the display device to sequentially display movement of the position indicator in the determined directions to each of the adjacent positions until said position indicator moves to one of the terminating positions.

26. The gaming device of claim 25, wherein the non-terminating and terminating positions are rearranged upon the triggering of an event in the game.

27. The gaming device of claim 25, wherein at least one of the non-terminating and terminating positions is rearranged after at least one of the moves of the position indicator to one of the non-terminating positions.

28. The gaming device of claim 25, which includes a plurality of terminating positions, each arranged adjacent to one of the non terminating positions by the processor.

29. The gaming device of claim 25, which includes an award associated with at least one of the non-terminating positions, wherein said award is provided to the player if the position indicator moves to said non-terminating position.

30. The gaming device of claim 29, wherein the award includes a multiplier.

31. The gaming device of claim 29, which includes an award associated with at least one of the terminating positions which is larger than any award associated with any of the non-terminating positions.

32. The gaming device of claim 25, which includes a plurality of awards associated with a plurality of the non-terminating positions, wherein the player is provided each award associated with each non-terminating position moved to by the position indicator.

33. The gaming device of claim 32, wherein the award associated with one of the non-terminating positions is larger than any award associated with any of the non-terminating positions and the position indicator does not move after moving to said non-terminating position.

34. The gaming device of claim 25, which includes a plurality of awards, wherein one of said awards is associated with each non-terminating position, wherein the player is provided each award associated with each non-terminating position moved to by the position indicator.

35. The gaming device of claim 25, which includes an award provided to the player based on a number of non-terminating positions moved to by the position indicator.

36. The gaming device of claim 25, which includes a consolation award associated with at least one of the terminating positions.

37. The gaming device of claim 25, wherein each of said different directions of movement has an equal probability of being selected.

38. The gaming device of claim 25, which has an electronic configuration adapted to receive input through a network.

39. The gaming device of claim 38, wherein the network is selected from the group consisting of a playing station network, a local area network, a wide area network and an internet.

40. A gaming device comprising:

a game operable upon a wager by a player;

a plurality of positions which include a plurality of non-terminating adjacently arranged positions and a plurality of terminating positions, each arranged adjacent to at least one of the non-terminating positions;

a processor operable to fix the arrangement of the non-terminating and terminating positions before sequentially randomly determining a plurality of directions of movement from at least two different directions of movement independent of the arrangement of the terminating and non-terminating positions;

a position indicator which sequentially moves to one of the adjacent positions for each of the sequential directions determined by said processor until said position indicator moves to one of the terminating positions; and a display device operable to display the terminating and non-terminating positions and the position indicator moving to said terminating and non-terminating positions.

41. The gaming device of claim 40, which includes an award associated with a final one of the terminating positions.

42. The gaming device of claim 40, which includes an award associated with at least one of the non-terminating positions, wherein said award is provided to the player if the position indicator moves to said non-terminating position.

43. The gaming device of claim 42, wherein the award includes a multiplier.

44. The gaming device of claim 42, which includes an award associated with at least one of the terminating positions which is larger than any award associated with any of the terminating positions.

45. The gaming device of claim 40, which includes a plurality of awards associated with a plurality of the non-terminating positions, wherein the player is provided each award associated with each non-terminating position moved to by the position indicator.

46. The gaming device of claim 45, wherein the award associated with one of the non-terminating positions is larger than any award associated with the non-terminating positions and the position indicator does not move after moving to said non-terminating position.

47. The gaming device of claim 40, which includes a plurality of awards, wherein one of said awards is associated with each non-terminating position, and wherein the player is provided each award associated with each non-terminating position moved to by the position indicator.

48. The gaming device of claim 40, which includes an award provided to the player based on a number of non-terminating positions moved to by the position indicator.

49. The gaming device of claim 40, which includes a consolation award associated with at least one of the terminating positions.

50. The gaming device of claim 40, wherein each of said different directions of movement has an equal probability of being selected.

51. The gaming device of claim 40, which has an electronic configuration adapted to receive input through a network.

52. The gaming device of claim 51, wherein the network is selected from the group consisting of a playing station network, a local area network, a wide area network and an internet.

53. A method for operating a gaming device having a game operable upon a wager by a player, the method comprising:

triggering the game; displaying a position indicator, a plurality of adjacently arranged non-terminating positions and at least one terminating position arranged adjacent to at least one of the non-terminating positions;

using a processor to sequentially randomly determine a plurality of directions of movement of the position indicator each from at least two different directions of movement and each independent of the arrangement of the terminating and non-terminating positions;

moving the position indicator to each of said adjacent positions in said determined sequential directions until said position indicator moves to one of said terminating positions; and displaying the position indicator moving to said terminating and non-terminating positions.

54. The method of claim 53, wherein the step of displaying at least one terminating position includes displaying a plurality of terminating positions each arranged adjacent to one of the non-terminating positions.

55. The method of claim 53, which includes the step of fixing the non-terminating and terminating positions prior to the step of using a processor to sequentially randomly determine the plurality of directions of movement of the position indicator.

56. The method of claim 53, which includes the step of associating an award with at least one of the non-terminating positions, wherein said award is provided to the player if the position indicator moves to said non-terminating position.

57. The method of claim 56, wherein said award provided to said player includes a multiplier.

58. The method of claim 56, which includes associating with at least one of the terminating positions an award which is larger than other said awards and providing said award to the player if the position indicator moves to said terminating position.

59. The method of claim 53, which includes the step of associating a plurality of awards with a plurality of the non-terminating positions, wherein the player is provided each award associated with each non-terminating position moved to by the position indicator.

60. The method of claim 59, wherein one of said plurality of awards associated with one of the non-terminating positions is larger than any award associated with any of the non-terminating positions, and the position indicator does not move after moving to said non-terminating position.

61. The method of claim 53, which includes the step of associating one of a plurality of awards with each non-terminating position, and providing the player each of said awards associated with each non-terminating position moved to by the position indicator.

62. The method of claim 53, which includes providing the player an award based on a number of non-terminating positions moved to by the position indicator.

63. The method of claim 53, which includes the step of providing the player a consolation award associated with at least one of the terminating positions.

64. The method of claim 53, wherein each of said different directions of movement has an equal probability of being selected.

65. The method of claim 53, which includes the step of adapting an electronic configuration to receive input through a network.

66. The method of claim 65, wherein said network is selected from the group consisting of a playing station network, a local area network, a wide area network and an internet.

67. A method for operating a gaming device having a game operable upon a wager by a player, the method comprising:

triggering the game;

displaying a plurality of adjacently arranged positions and a position indicator, said positions including a plurality of non-terminating positions and at least one terminating position, and said position indicator movable to each of said positions;

associating an award with at least one of the non-terminating positions;

using a processor to sequentially randomly determine a plurality of directions of movement of the position indicator from at least two different directions of movement and independent of the arrangement of the terminating and non-terminating positions;

sequentially moving the position indicator to one of the adjacently arranged positions for each of the determined sequential directions until the position indicator moves to the terminating position;

providing the player any award associated with the non-terminating positions the position indicator moves to; and displaying the position indicator moving to said terminating and non-terminating positions.

68. The method of claim 67, wherein the award associated with at least one of the non-terminating positions includes a multiplier.

69. The method of claim 67, wherein the award associated with at least one of the non-terminating positions is larger than other awards, and the position indicator does not move after moving to said non terminating positions.

70. The method of claim 67, which includes the step of associating with at least one terminating position an award which is larger than other said awards and providing the player said award if the position indicator moves to said terminating position.

71. The method of claim 67, which includes the step of providing the player a consolation award associated with the terminating position moved to by the position indicator.

72. The method of claim 67, wherein each of said different directions of movement has an equal probability of being selected.

73. The method of claim 67, which includes the step of adapting an electronic configuration to receive input through a network.

74. The method of claim 73, wherein said network is selected from the group consisting of a playing station network, a local area network, a wide area network and an internet.

75. A method for operating a gaming device having a game operable upon a wager by a player, the method comprising:

triggering the game;

displaying a plurality of adjacently arranged positions and a position indicator, wherein the positions include a plurality of non-terminating positions and at least one terminating position, and the position indicator is displayable at each of said plurality of positions;

randomly arranging the non-terminating and terminating positions;

using a processor to sequentially randomly determine a plurality of directions of movement of the position indicator each from at least two different directions of movement and each independent of the arrangement of the terminating and non-terminating positions;

moving the position indicator to the position in the selected direction until the position indicator moves to the terminating position; and displaying the position indicator moving to said terminating and non-terminating positions.

76. The method of claim 75, wherein the non-terminating and terminating positions are re-arranged upon the triggering of an event.

77. The method of claim 75, wherein the non-terminating and terminating positions are re-arranged after each move to one of the non-terminating positions.

78. The method of claim 75, which includes the step of associating an award with at least one of the non-terminating positions, wherein said award is provided to the player if the position indicator moves to said non-terminating position.

79. The method of claim 78, wherein said award provided to said player includes a multiplier.

80. The method of claim 78, which includes associating with at least one of the terminating positions an award which is larger than any award associated with any of the non-terminating positions and providing said award to the player if the position indicator moves to said terminating position.

81. The method of claim 75, which includes the step of associating a plurality of awards with a plurality of the non-terminating positions, wherein the player is provided each award associated with each non-terminating position moved to by the position indicator.

82. The method of claim 81, wherein one of said plurality of awards associated with one of the non-terminating positions is larger than any award associated with any of the non-terminating positions and the position indicator does not move after moving to said non-terminating position.

83. The method of claim 75, which includes the step of associating one of a plurality of awards with each non-terminating position, and providing the player each of said awards associated with each non-terminating position moved to by the position indicator.

84. The method of claim 75, which includes providing the player an award based on a number of non-terminating positions moved to by the position indicator.

85. The method of claim 75, which includes the step of providing the player a consolation award associated with at least one of the terminating positions.

86. The method of claim 75, wherein each of said different directions of movement has an equal probability of being selected.

87. The method of claim 75, which includes the step of adapting an electronic configuration to receive input through a network.

88. The method of claim 87, wherein said network is selected from the group consisting of a playing station network, a local area network, a wide area network and an internet.

89. A method for operating a gaming device having a game operable upon a wager by a player, the method comprising:

triggering the game;

displaying a position indicator and a plurality of positions which include a plurality of non-terminating adjacently arranged positions and a plurality of terminating positions, each arranged adjacent to at least one of the non-terminating positions;

fixing the non-terminating and terminating positions;

using a processor to sequentially randomly determine a plurality of directions of movement of said position indicator from at least two different directions of movement, each determination independent of the arrangement of the terminating and non-terminating positions;

sequentially moving the position indicator to one of the adjacent positions for each of the determined sequential directions until said position indicator moves to one of the terminating positions: and displaying the position indicator moving to said terminating and non-terminating positions.

90. The method of claim 89, wherein the step of fixing the non-terminating and terminating positions includes allowing a first move of the position indicator only to non-terminating positions.

91. The method of claim 89, which includes the step of associating an award with at least one of the non-terminating positions, wherein said award is provided to the player if the position indicator moves to said non-terminating position.

92. The method of claim 91, wherein said award provided to said player includes a multiplier.

93. The method of claim 91, which includes associating with at least one of the terminating positions an award which is larger than any award associated with any of the non-terminating positions and providing said award to the player if the position indicator moves to said terminating position.

94. The method of claim 89, which includes the step of associating a plurality of awards with a plurality of the non-terminating positions, wherein the player is provided each award associated with each non-terminating position moved to by the position indicator.

95. The method of claim 94, wherein one of said plurality of awards associated with one of the non-terminating positions is larger than any award associated with any of the non-terminating positions and the position indicator does not move after moving to said non-terminating position.

96. The method of claim 89, which includes providing the player an award based on a number of non-terminating positions moved to by the position indicator.

97. The method of claim 89, which includes the step of providing the player a consolation award associated with at least one of the terminating positions.

98. The method of claim 89, wherein each of said different directions of movement has an equal probability of being selected.

99. The method of claim 89, which includes the step of adapting an electronic configuration to receive input through a network.

100. The method of claim 99, wherein said network is selected from the group consisting of a playing station network, a local area network, a wide area network and an internet.

* * * * *